US010600347B2

(12) United States Patent
Hong

(10) Patent No.: US 10,600,347 B2
(45) Date of Patent: Mar. 24, 2020

(54) ORGANIC LIGHT EMITTING DISPLAY DEVICE AND CONTROLLER

(71) Applicant: LG Display Co., Ltd., Seoul (KR)

(72) Inventor: MooKyoung Hong, Jinhae-si (KR)

(73) Assignee: LG Display Co., Ltd., Seoul (KR)

( * ) Notice: Subject to any disclaimer, the term of this patent is extended or adjusted under 35 U.S.C. 154(b) by 160 days.

(21) Appl. No.: 15/684,510

(22) Filed: Aug. 23, 2017

(65) Prior Publication Data

US 2018/0061295 A1 Mar. 1, 2018

(30) Foreign Application Priority Data

Aug. 30, 2016 (KR) ..... 10-2016-0110629

(51) Int. Cl.

| | |
|---|---|
| ***G09G 3/00*** | (2006.01) |
| ***G09G 3/3233*** | (2016.01) |
| ***G09G 3/3225*** | (2016.01) |
| ***G09G 3/3266*** | (2016.01) |
| ***G09G 3/3283*** | (2016.01) |

(52) U.S. Cl.

CPC ..... *G09G 3/006* (2013.01); *G09G 3/3225* (2013.01); *G09G 3/3233* (2013.01); *G09G 3/3266* (2013.01); *G09G 3/3283* (2013.01); *G09G 2300/0842* (2013.01); *G09G 2310/08* (2013.01); *G09G 2320/029* (2013.01); *G09G 2320/0233* (2013.01); *G09G 2320/0295* (2013.01); *G09G 2320/043* (2013.01); *G09G 2320/0693* (2013.01); *G09G 2330/08* (2013.01); *G09G 2370/08* (2013.01)

(58) Field of Classification Search

CPC .... G09G 3/006; G09G 3/3225; G09G 3/3233; G09G 3/3266; G09G 3/3283; G09G 2300/0842; G09G 2310/08; G09G 2320/0233; G09G 2320/029; G09G 2320/0295; G09G 2320/043; G09G 2320/0693; G09G 2330/08; G09G 2370/08

USPC ..... 345/696

See application file for complete search history.

(56) References Cited

U.S. PATENT DOCUMENTS

2007/0032974 A1* 2/2007 Muniraju ..... G01D 18/008 702/85

2008/0001897 A1* 1/2008 Lim ..... G09G 3/3688 345/98

(Continued)

*Primary Examiner* — Mark Edwards

(74) *Attorney, Agent, or Firm* — Polsinelli PC

(57) ABSTRACT

The present disclosure relates to an organic light emitting display device that performs sensing and compensation for a characteristic value of a subpixel, and provide the organic light emitting display device that detects whether a sensing environment has a defect via transceiving a signal between a controller and a data driver before sensing is performed in a period in which the characteristic value of the subpixel is sensed, and controls sensing of the characteristic value of the subpixel according to detection of whether the sensing environment has a defect. According to the present disclosure, an error of sensing data due to a defect in the sensing environment may be prevented and an image abnormality due to compensation performed based on erroneous sensing data may be prevented, by detecting a defect in the sensing environment and stopping sensing of the characteristic value of the subpixel when the sensing environment has a defect.

20 Claims, 10 Drawing Sheets

(56) References Cited

U.S. PATENT DOCUMENTS

| | | | | |
|---|---|---|---|---|
| 2014/0176516 | A1* | 6/2014 | Kim | G09G 3/3233 345/204 |
| 2016/0063910 | A1* | 3/2016 | An | G09G 3/3233 345/691 |

* cited by examiner

ORGANIC LIGHT EMITTING DISPLAY DEVICE AND CONTROLLER

CROSS REFERENCE TO RELATED APPLICATION

This application claims priority from Korean Patent Application No. 10-2016-0110629, filed on Aug. 30, 2016, which is hereby incorporated by reference in its entirety for all purposes as if fully set forth herein.

BACKGROUND

Field of the Disclosure

The present disclosure relates to a display device, and more particularly, to an organic light emitting display device and a controller included in the organic light emitting display device.

Description of the Background

Recently, an organic light emitting display device is coming into the spotlight as a display device which has advantages, such as a fast response rate, a high contrast ratio, a high light emitting efficiency, a high luminance, and a wide viewing angle, by using an organic light emitting diode (OLED) which emits light by itself.

Such an organic light emitting display device displays an image by arranging organic light emitting diodes (OLEDs) and subpixels including a driving transistor, which drives the organic light emitting diodes, in a matrix form, and controlling brightness of a subpixel selected by a scan signal, according to gradation of data.

Circuit elements, such as the organic light emitting diodes (OLEDs) and the driving transistor, are degraded as a driving time passes.

As deterioration of the organic light emitting diodes (OLEDs) or the driving transistor included in the subpixel progresses, a unique characteristic value of each circuit element, such as a threshold voltage, a mobility, etc., becomes changed.

Due to a change in a unique characteristic value of each circuit element, a subpixel including a corresponding circuit element cannot accurately express brightness according to gradation of data, and this causes an overall image abnormality of an image displayed through an organic light emitting display panel.

Therefore, a technique of sensing characteristic values of circuit elements included in such subpixels and performing compensation of such changes according to a sensing result has been developed and applied.

However, there can occur an error in a procedure of measuring or transmitting sensing data for unique characteristic values of circuit elements, and such an error prevents accurate sensing and compensation, and thus results in a problem of generating defects in sensing and compensation.

SUMMARY DISCLOSURE

An aspect of the present aspects is to provide an organic light emitting display device capable of detecting a defect in an environment for sensing of a characteristic value of a subpixel disposed on an organic light emitting display panel.

An aspect of the present aspects is to provide an organic light emitting display device that accurately senses a characteristic value of a subpixel disposed on an organic light emitting display panel, and prevents a defect of compensation based on sensing data.

An aspect of the present aspects is to provide an organic light emitting display device that prevents an image abnormality due to degradation of a circuit element included in a subpixel, through accurate sensing and compensation for a characteristic value of a subpixel disposed on an organic light emitting display panel.

In an aspect, the present aspects provide an organic light emitting display device including: an organic light emitting display panel that includes a plurality of gate lines and a plurality of data lines arranged therein, and a plurality of subpixels arranged in areas where the gate lines and the data lines intersect; a gate driver that drives the plurality of gate lines; a data driver that drives the plurality of data lines; and a controller that controls the gate driver and the data driver.

This organic light emitting display device may include a sensing unit that is disposed in the data driver, and senses characteristic values of the subpixels arranged in the organic light emitting display panel during a sensing period.

Further, the organic light emitting display device may include a sensing control unit that is disposed in the controller, transmits a command signal to the sensing unit before the sensing unit senses characteristic values of the subpixels in the sensing period, receives a feedback signal for the command signal, and outputs a control signal that controls the sensing unit according to the received feedback signal.

This sensing control unit compares the feedback signal received from the sensing unit with a response signal predesignated for the command signal transmitted to the sensing unit, and outputs the control signal that controls the sensing unit according to a comparison result.

The sensing control unit may transmit a sensing stop control signal to the sensing unit when the feedback signal received from the sensing unit does not match the predesignated response signal.

Alternatively, the sensing control unit may increase a defect count by one when the feedback signal received from the sensing unit does not match the predesignated response signal, and may transmit a sensing stop control signal to the sensing unit when the defect count has a value equal to or larger than a preconfigured number of times.

At this time, the sensing control unit may reset the defect count when the feedback signal matches the predesignated response signal.

This organic light emitting display device may further include a compensation unit that generates compensation data based on sensing data when the sensing data is received from the sensing unit in a state where a sensing stop control signal that stops sensing of the sensing unit is not output.

In another aspect, the present aspects provide a controller that transmits a command signal to a data driver before the data driver senses characteristic values of subpixels, and controls sensing of characteristic values of the subpixels by the data driver according to a feedback signal of the command signal.

This controller includes: a signal transmission unit that transmits a command signal to a data driver before the data driver senses characteristic values of subpixels arranged in an organic light emitting display panel in a sensing period in which characteristic values of the subpixels are sensed; a signal reception unit that receives a feedback signal for the transmitted command signal; and a sensing control unit that controls transmission of the command signal, compares the received feedback signal with a response signal predesignated for the transmitted command signal, and outputs a control signal that controls sensing of characteristic values of the subpixels of the data driver according to a comparison result.

Here, the sensing control unit may increase a defect count by one or output a sensing stop control signal that stops sensing of characteristic values of the subpixels of the data driver when the received feedback signal does not match the predesignated response signal, and may output a sensing stop control signal when the defect count has a value equal to or larger than a preconfigured number of times.

In a case where the sensing control unit adjusts the defect count according to the feedback signal, the sensing control unit resets the defect count and controls sensing of the subpixels of the data driver when the received feedback signal matches the predesignated response signal.

According to the present aspects, sensing and compensation defects caused by a defect in a sensing environment can be prevented by checking whether there is an abnormality in the sensing environment and then sensing characteristic values of subpixels arranged in an organic light emitting display panel.

According to the present aspects, an image abnormality that may occur due to sensing and compensation defects can be prevented by controlling whether or not to sense characteristic values of subpixels according to detection of a defect in a sensing environment.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

Figure 1:
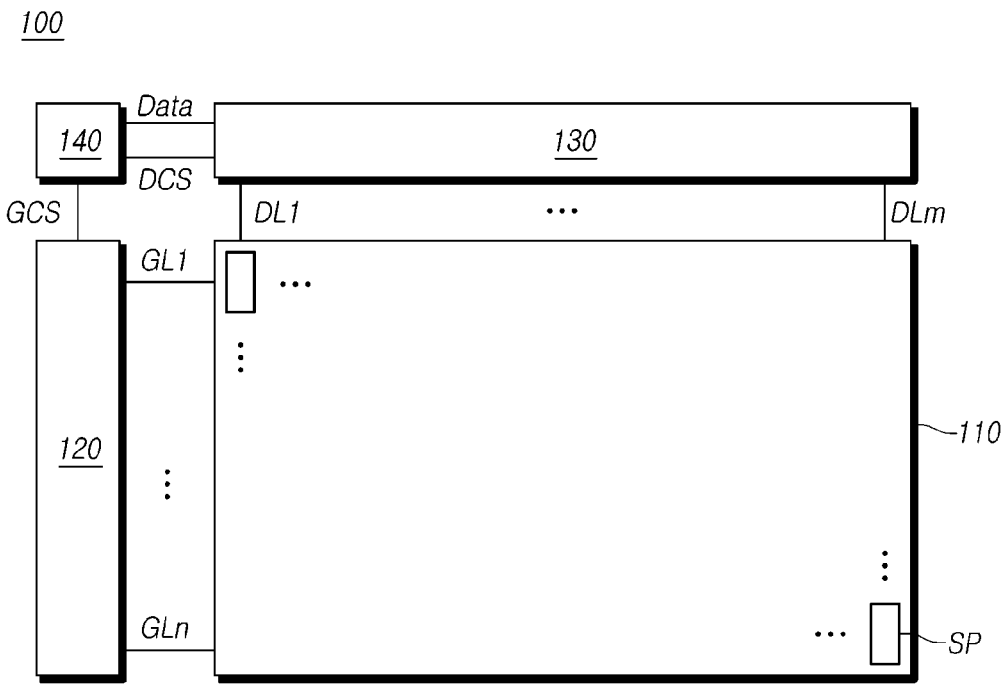
FIG. 1 is a diagram illustrating a schematic configuration of an organic light emitting display device according to the present disclosure.

Hereinafter, some aspects of the present disclosure will be described in detail with reference to the accompanying illustrative drawings. In designating elements of the drawings by reference numerals, the same elements will be designated by the same reference numerals although they are shown in different drawings. Further, in the following description of the present disclosure, a detailed description of known functions and configurations incorporated herein will be omitted when it may make the subject matter of the present disclosure rather unclear.

In addition, terms, such as first, second, A, B, (a), (b) or the like may be used herein when describing components of the present disclosure. These terms are merely used to distinguish one component from other components, and the property, order, sequence and the like of the corresponding component are not limited by the corresponding term. In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 illustrates a schematic configuration of an organic light emitting display device 100 according to the present disclosure.

Referring to FIG. 1, the organic light emitting display device 100 according to the present disclosure includes an organic light emitting display panel that has a plurality of gate lines GL and a plurality of data lines DL arranged therein, and a plurality of subpixels arranged therein; a gate driver 120 that drives the plurality of gate lines DL; a data driver 130 that drives the plurality of data lines DL; and a controller 140 that controls the gate driver 120 and the data driver 130.

The gate driver 120 sequentially supplies scan signals to the plurality of gate lines GL and thus sequentially drives the plurality of gate lines GL.

The gate driver 120 sequentially supplies scan signals of ON voltage or OFF voltage to the plurality of gate lines GL under the control of the controller 140, and thus sequentially drives the plurality of gate lines GL.

The gate driver 120 may be positioned at one side of the organic light emitting display panel 110 or may be positioned at both sides of the organic light emitting display panel 110 according to a driving scheme.

Further, the gate driver 120 may include one or more gate driver integrated circuits.

Each gate driver integrated circuit may be connected to a bonding pad of the organic light emitting display panel by using a tape automated bonding (TAB) scheme or a chip on glass (COG) scheme, or may be implemented as a gate in panel (GIP) type to be directly disposed in the organic light emitting display panel 110.

Further, each gate driver integrated circuit may be integrated and disposed in the organic light emitting display panel 110, and may be implemented as a chip on film (COF) scheme by which the gate driver integrated circuit is mounted on a film connected with the organic light emitting display panel 110.

The data driver 130 drives the plurality of data lines DL by supplying a data voltage to the plurality of data lines DL.

The data driver 130 converts image data received from the controller 140 into a data voltage having an analog format and supplies the converted data voltage to the plurality of data lines DL, so as to drive the plurality of data lines DL.

The data driver 130 may include at least one source driver integrated circuit, and drive the plurality of data lines DL.

Each source driver integrated circuit may be connected to the bonding pad of the organic light emitting display panel 110 by using a tape automated bonding (TAB) scheme or a chip on glass (COG) scheme, may be directly disposed in the organic light emitting display panel 110, or may be integrated and disposed in the organic light emitting display panel 110.

Further, each source driver integrated circuit may be implemented as a chip on film (COF) scheme. In this case, one end of the each source driver integrated circuit is bonded to at least one source printed circuit board, and the other end is bonded to the organic light emitting display panel 110.

The controller 140 supplies various control signals to the gate driver 120 and the data driver 130 so as to control the gate driver 120 and the data driver 130.

The controller 140 starts a scan according to timing implemented in each frame, switches input image data received from the outside according to a data signal format used in the data driver 130, outputs the switched image data, and controls data driving according to a proper time based on the scan.

The controller 140 receives various timing signals including a vertical synchronization signal (Vsync), a horizontal synchronization signal (Hsync), an input Data Enable (DE) signal, a clock signal (CLK), and the like as well as the input image data, from the outside (for example, a host system).

In addition to switching the input image data received from the outside according to the data signal format used in the data driver 130 and outputting the switched image data, the controller 140 receives timing signals, such as a vertical synchronization signal (Vsync), a horizontal synchronization signal (Hsync), an input Data Enable (DE) signal, a clock signal (CLK), etc., to generate various control signals, and outputs the generated control signals to the gate driver 120 and the data driver 130 in order to control the gate driver 120 and the data driver 130.

For example, in order to control the gate driver 120, the controller 140 outputs various gate control signals (GCSs) including a gate start pulse (GSP), a gate shift clock (GSC), a gate output enable (GOE) signal, and the like.

Here, the gate start pulse (GSP) controls operation start timing of one or more gate driver integrated circuits constituting the gate driver 120. The gate shift clock (GSC) is a clock signal commonly input to one or more gate driver integrated circuits, and controls shift timing of a scan signal (e.g., gate pulse). The gate output enable (GOE) signal designates timing information of one or more gate driver integrated circuits.

Further, in order to control the data driver 130, the controller 140 outputs various data control signals (DCSs) including a source start pulse (SSP), a source sampling clock (SSC), a source output enable (SOE) signal, and the like.

Here, the source start pulse (SSP) controls data sampling start timing of one or more source driver integrated circuits constituting the data driver 130. The source sampling clock (SSC) is a clock signal that controls sampling timing of data in each source driver integrated circuit. The source output enable (SOE) signal controls output timing of the data driver 130.

The controller 140 may be disposed on a control printed circuit board that is connected with a source printed circuit board, to which source driver integrated circuits are bonded, through a connection medium, such as a flexible flat cable (FFC), a flexible printed circuit (FPC), and the like.

The control printed circuit board may further include a power controller (not illustrated) disposed thereon, which supplies various voltages or currents to the organic light emitting display panel 110, the gate driver 120, the data driver 130, etc., or controls various voltages or currents to be supplied. This power controller is also referred to as a power management IC.

Each subpixel disposed in the organic light emitting display panel 110 in the organic light emitting display device 100 may include a circuit element, such as an organic light emitting diode, two or more transistors, and at least one capacitor.

A type and the number of circuit elements constituting each subpixel may be variously determined according to a providing function, a design scheme, and the like.

Figure 2:
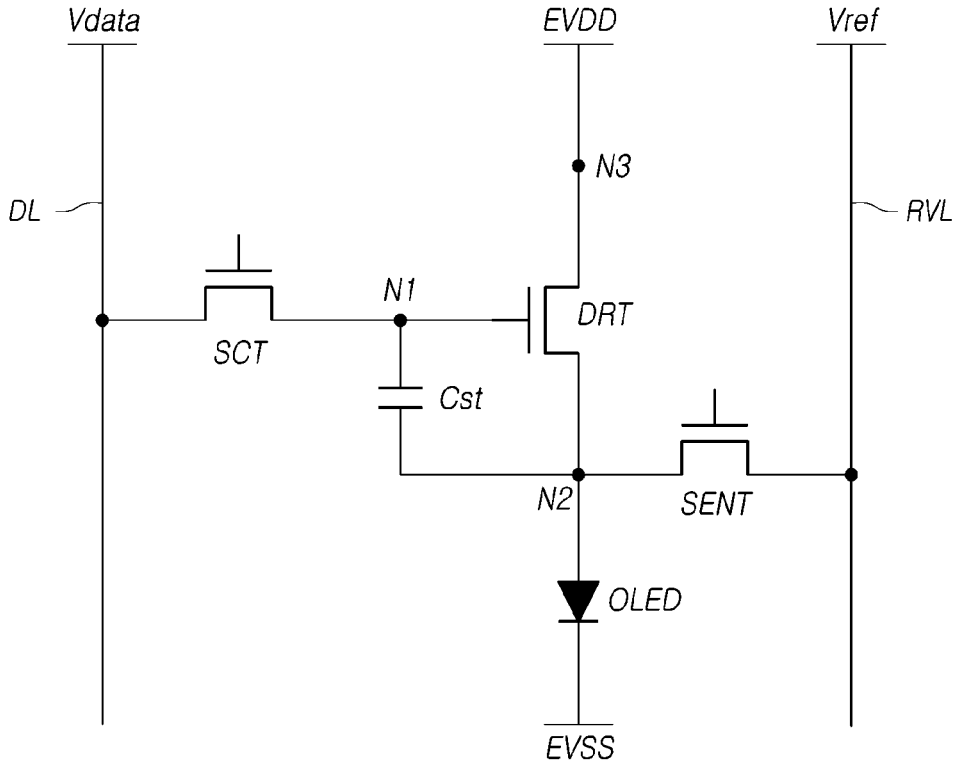
FIG. 2 is a circuit diagram illustrating an example of a subpixel structure of an organic light emitting display device according to the present disclosure.

FIG. 2 illustrates an example of a structure of a subpixel disposed in the organic light emitting display panel 110 according to the present disclosure.

Referring to FIG. 2, each subpixel includes an organic light emitting diode (OLED) and a driving transistor DRT that drives the organic light emitting diode OLED.

Further, the subpixel includes a storage capacitor Cst electrically connected between a first node N1 and a second node N2 of the driving transistor DRT, a scan transistor SCT that is controlled by a scan signal and electrically connected between the first node N1 of the driving transistor DRT and a corresponding data line DL, and a sensing transistor SENT electrically connected between the second node N2 of the driving transistor DRT and a corresponding reference voltage line (RVL).

Although not illustrated in FIG. 2, the organic light emitting diode OLED includes a first electrode (e.g., an anode electrode or a cathode electrode), an organic layer, and a second electrode (e.g., a cathode electrode or an anode electrode).

For example, the first electrode of the organic light emitting diode OLED may be connected with the second node N2 of the driving transistor DRT, and a base voltage EVSS may be applied to the second electrode of the organic light emitting diode OLED.

The driving transistor DRT is a transistor that supplies a driving current to the organic light emitting diode OLED to drive the organic light emitting diode OLED, and has the first node N1 corresponding to a gate node, the second node D2 corresponding to a source node or a drain node, and a third node N3 corresponding to a drain node or a source node.

The scan transistor SCT is a transistor that transfers a data voltage to the first node N1 of the driving transistor DRT, and the scan transistor SCT may be electrically connected between the first node N1 of the driving transistor DRT and the data line DL and turned on by a scan signal applied to the gate node so as to transfer a data voltage to the first node N1 of the driving transistor DRT.

The storage capacitor Cst may be electrically connected between the first node N1 and the second node N2 of the driving transistor DRT to maintain a constant voltage during a period of one frame.

The sensing transistor SENT may be electrically connected between the second node N2 of the driving transistor DRT and the reference voltage line (RVL), and controlled by a scan signal applied to the gate node.

The sensing transistor SENT may be turned on to apply a reference voltage Vref supplied through the reference voltage line (RVL) to the second node N2 of the driving transistor DRT.

Further, the sensing transistor SENT may be used to sense characteristic values (e.g., a threshold value, a mobility, etc.) of the circuit element, such as the organic light emitting diode OLED and the driving transistor DRT included in the subpixel.

Figure 3:
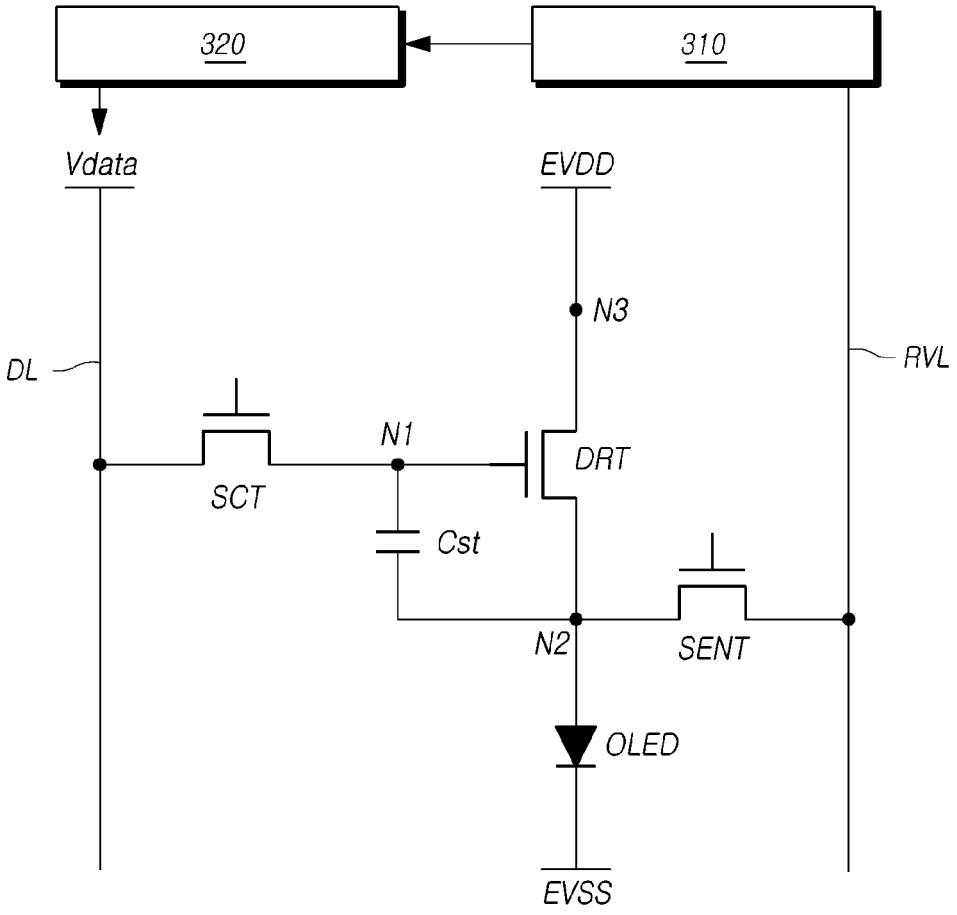
FIG. 3 is a circuit diagram illustrating an example of a configuration of sensing and compensating for a characteristic value of a subpixel in an organic light emitting display device according to the present disclosure.

FIG. 3 illustrates a configuration of sensing and compensating for a characteristic value (hereinafter, referred to as "a characteristic value of a subpixel") of a circuit element included in a subpixel in the organic light emitting display device 100 according to the present disclosure.

Referring to FIG. 3, the organic light emitting display device 100 according to the present disclosure includes a sensing unit 310 connected with a reference voltage line (RVL), and a compensation unit 320 that receives sensing data from the sensing unit 310 and performs compensation based on the received sensing data.

The sensing unit 310 may sense a voltage of the reference voltage line (RVL) in a sensing period in which a characteristic value of a subpixel is sensed, so as to sense a threshold voltage, a mobility, etc., of a driving transistor DRT or an organic light emitting diode OLED included in the subpixel.

For example, the sensing unit 310 initializes the reference voltage line (RVL) during the sensing period, applies a data voltage for sensing to a data line DL, and then turns on a scan transistor SCT to apply the voltage to a first node N1 and a second node N2.

Further, the sensing unit 310 maintains the scan transistor SCT and a sensing transistor SENT off so that a voltage of the second node N2 is floated.

When a predetermined time passes, the sensing unit 310 turns on the sensing transistor SENT to measure the voltage of the second node N2 through the reference voltage line (RVL).

The sensing unit 310 converts a measured voltage value into sensing data and transfers the converted sensing data to the compensation unit 320.

The compensation unit 320 measures a characteristic value of the subpixel based on the sensing data received from the sensing unit 310, and generates compensation data based on the sensing data.

The compensation unit 320 may be positioned inside or outside of the controller 140 (shown in FIG. 1), and may perform compensation for a change in the characteristic value of the subpixel by applying, to the data line DL, the data voltage Vdata to which the compensation data generated by the compensation unit 320 is applied.

When a defect occurs in such an environment in which a characteristic value of the subpixel is sensed and compensated, an error of sensing data may occur during a procedure of acquiring and transmitting the sensing data, and the error of the sensing data may result a problem of erroneous compensation.

The present disclosure enables detection of whether an environment for sensing of a characteristic value of a subpixel has a defect or not, thereby preventing erroneous sensing and compensation due to the defect of the sensing environment.

FIG. 4 to FIG. 7 illustrate configurations between the data driver 130 and the controller 140, which detect a defect in an environment for sensing of a characteristic value of a subpixel in the organic light emitting display device 100.

Figure 4:
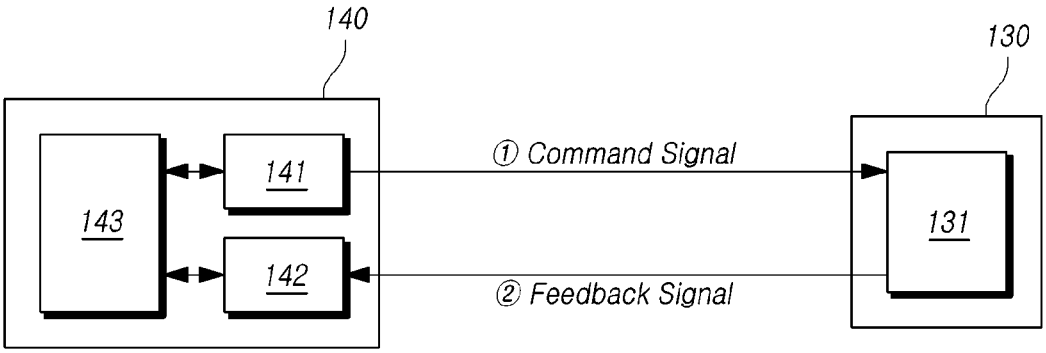
FIG. 4 to FIG. 6 are diagrams illustrating configurations of a data driver and a controller in an organic light emitting display device according to the present disclosure.
Figure 5:
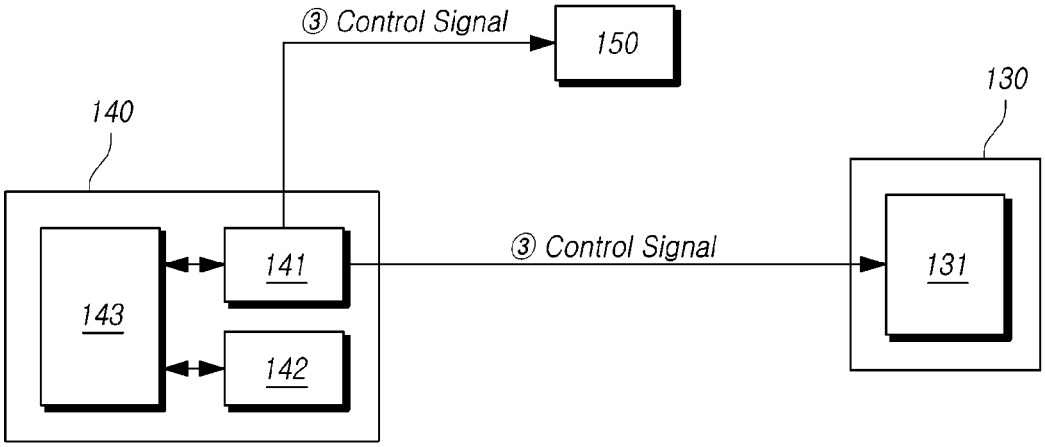
Figure 6:
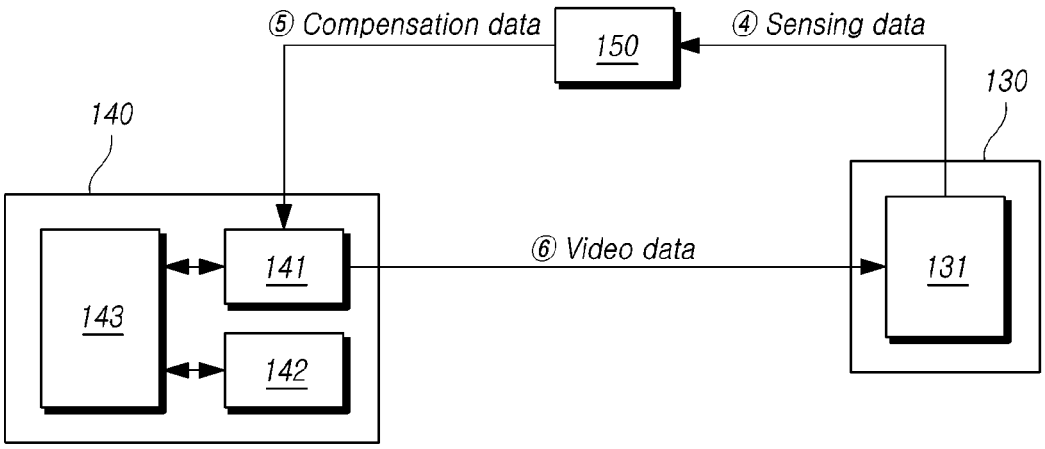
Figure 7:
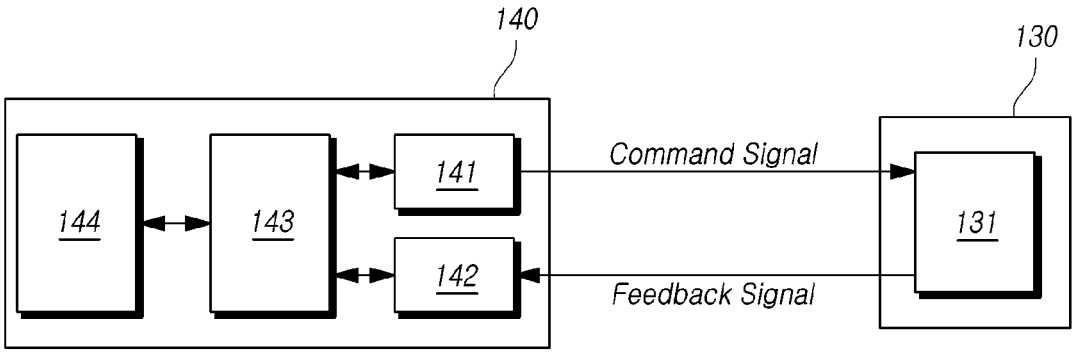
FIG. 7 is a diagram illustrating another configuration of a data driver and a controller in an organic light emitting display device according to the present disclosure.

FIG. 4 to FIG. 6 illustrate a case where sensing is controlled according to a feedback signal received from the data driver 130, and FIG. 7 illustrates a case where sensing is controlled based on an error of a received feedback signal and the number of times of occurrence of the error.

Referring to FIG. 4, the data driver 130 may include a sensing unit 131 that senses a characteristic value of a subpixel, and the controller 140 may include a signal transmission unit 141, a signal reception unit 142, and a sensing control unit 143.

The sensing unit 131 disposed in the data driver 130 senses a characteristic value of a subpixel during a sensing period in which the characteristic value of the subpixel is sensed, and transfers sensing data to a compensation unit 150 (shown in FIGS. 5 and 6) positioned inside or outside of the controller 140.

At this time, before the sensing unit 131 senses the characteristic value of the subpixel, the controller 140 checks whether there is a defect in an environment for sensing of the characteristic value of the subpixel, and controls sensing of the characteristic value of the subpixel by the sensing unit 131.

Specifically, the signal transmission unit 141 of the controller 140 transmits a command signal to the sensing unit 131 before the sensing unit 131 senses the characteristic value of the subpixel during the sensing period for sensing of the characteristic value of the subpixel.

A response signal is designated for each command signal, and information relating to both the command signal and the response signal may be stored in the controller 140 and the data driver 130.

The command signal may be transmitted through a packet allocated at a transceiving interface between the controller 140 and the data driver 130, and may be configured by, for example, X bits.

Further, a response signal designated for each command signal may be configured by Y bits, in which Y bits may be configured to be a value larger than X bits in order to detect a defect in a sensing environment through reception of the reception signal.

When the signal transmission unit 141 transmits the command signal to the sensing unit 131, the sensing unit 131 checks the command signal and transmits a feedback signal for the command signal to the signal reception unit 142 of the controller 140.

When the signal reception unit 142 receives the feedback signal from the sensing unit 131, the signal reception unit 142 transfers the received feedback signal to the sensing control unit 143.

The sensing control unit 143 controls command signal transmission of the signal transmission unit 141, and compares the feedback signal received through the signal reception unit 142 with a response signal designated for the transmitted command signal.

The sensing control unit 143 controls the command signal to be transmitted before the sensing unit 131 senses the characteristic value of the subpixel during the sensing period in which the sensing unit 131 senses the characteristic value of the subpixel.

Further, when the feedback signal is received in response to the transmitted command signal, the sensing control unit 143 checks whether the received feedback signal matches the response signal designated for the transmitted command signal.

The sensing control unit 143 transmits a control signal that controls whether the sensing unit 131 senses the characteristic value of the subpixel, according to a determination on whether the feedback signal matches the response signal.

That is, a sensing data error caused by a defect in a sensing environment may be prevented, and a compensation abnormality and an image abnormality based on the erroneous sensing data can be prevented, by detecting whether there is a defect in the sensing environment through checking the feedback signal transmitted before the sensing unit 131 senses the characteristic value of the subpixel and controlling sensing of the characteristic value of the subpixel by the sensing unit 131.

FIG. 5 illustrates a scheme in which the sensing control unit 143 controls sensing of a characteristic value of a subpixel by the sensing unit 131 according to a feedback signal received from the sensing unit 131.

Referring to FIG. 5, the sensing control unit 143 compares a feedback signal received from the sensing unit 131 with a response signal designated for a transmitted command signal.

When the feedback signal and the response signal designated for the command signal match based on a result of the comparison, the sensing control unit 143 transmits a sensing start control signal to the sensing unit 131 to enable the sensing unit 131 to sense a characteristic value of a subpixel.

When the feedback signal and the response signal designated for the command signal do not match each other, the sensing control unit 143 transmits a sensing stop control signal to the sensing unit 131 through the signal transmission unit 141.

When the sensing unit 131 receives the sensing stop control signal, the sensing unit 131 does not proceed with sensing of the characteristic value of the subpixel or does not transmit sensed data to the outside, so as to prevent sensing data from being transferred in a state where a sensing environment has a defect.

Further, when the sensing control unit 143 transmits a sensing stop control signal to the sensing unit 131, the sensing control unit 143 transmits a control signal to the compensation unit 150 that generates compensation data based on sensing data, and prevents compensation data from being generated based on erroneous sensing data.

At this time, the compensation unit 150 may be positioned inside the controller 140, but may be positioned outside the controller 140.

That is, when it is detected that the sensing environment has a defect, the sensing control unit 143 stops the sensing unit 131 from sensing the characteristic value of the subpixel and concurrently prevents the compensation unit 150 from generating compensation data based on erroneous sensing data, so as to prevent an image abnormality caused by erroneous sensing and erroneous compensation from occurring.

On the other hand, when it is detected that the sensing environment is normal, the sensing control unit 143 causes the sensing unit 131 to sense the characteristic value of the subpixel so as to enable compensation based on the sensing data is performed.

FIG. 6 illustrates a procedure to be performed when a feedback signal received from the sensing unit 131 matches a response signal designated for a transmitted command signal.

Referring to FIG. 6, the sensing control unit 143 of the controller 140 transmits a start control signal to the sensing unit 131 when a feedback signal received from the sensing unit 131 matches a response signal designated for a transmitted command signal.

The sensing unit 131 having received a sensing start control signal senses a characteristic value of a subpixel during a sensing period, and transmits acquired sensing data to the compensation unit 150.

The compensation unit 150 generates compensation data based on the sensing data received from the sensing unit 131, and transmits the generated compensation data to the controller 140.

Here, when the sensing data is received from the sensing unit 131 in a state where the controller 140 does not output a sensing stop control signal, the compensation unit 150 generates compensation data so as to enable compensation to be performed based on sensing data acquired when a sensing environment is normal.

When the controller 140 receives the compensation data from the compensation unit 150, the controller 140 transmits image data to which the compensation data is applied to the data driver 130.

Therefore, the data driver 130 outputs data for which compensation for the characteristic value of the subpixel is performed, so as to prevent an image abnormality from occurring even when the characteristic value of the subpixel changes.

Meanwhile, the controller 140 may control whether the sensing unit 131 performs sensing, based on the feedback signal received from the sensing unit 131. The controller 140 may control sensing of the characteristic value of the subpixel by the sensing unit 131 based on an error of the feedback signal and the number of times of occurrence of the error.

FIG. 7 illustrates a case where the controller 140 controls sensing of a characteristic value of a subpixel by the sensing unit 131 based on the number of times of occurrence of an error of a feedback signal of the sensing unit 131.

Referring to FIG. 7, the controller 140 includes the signal transmission unit 141, the signal reception unit 142, the sensing control unit 143, and a counter 144.

The sensing control unit 143 of the controller 140 transmits a command signal through the signal transmission unit 141 before the sensing unit 131 senses a characteristic value of a subpixel during a sensing period in which the sensing unit 131 senses the characteristic value of the subpixel.

The signal reception unit 142 receives a feedback signal from the sensing unit 131 in response to a transmitted command signal, and transmits the received feedback signal to the sensing control unit 143.

The sensing control unit 143 compares the received feedback signal with a response signal designated for the transmitted command signal, and controls the counter 144 based on a comparison result.

For example, when the feedback signal received from the sensing unit 131 does not match the response signal designated for the transmitted command signal, the sensing control unit 143 increases the counter 144 by one.

Further, the sensing control unit 143 checks whether or not the number of counting by the counter 144 is equal to or more than a preconfigured number of times (e.g., three times).

The sensing control unit 143 transmits a sensing stop control signal to the sensing unit 131 when the number of counting is equal to or more than a preconfigured number of times, and transmits a sensing start control signal to the sensing unit 131 otherwise.

That is, the sensing control unit 143 stops sensing of the characteristic value of the subpixel by the sensing unit 131 only when a preconfigured number of times of errors or more are detected in a sensing environment. Further, in a case where an error of the sensing data is not affected due to a temporary defect in the sensing environment, the sensing control unit 143 causes the sensing unit 131 to sense the characteristic value of the subpixel, so as to enable compensation for a change in the characteristic value of the subpixel is performed through sensing and compensation.

Meanwhile, when the feedback signal received from the sensing unit 131 matches the response signal designated for the transmitted command signal, the sensing control unit 143 may transmit a sensing start control signal to the sensing unit 131 and reset the counter 144.

Therefore, only in a case where a possibility of occurrence of a sensing data error due to a defect in the sensing environment is very high, which corresponds to a case where defects are consecutively detected in the sensing environment, the sensing control unit 143 stops sensing of the characteristic value of the subpixel by the sensing unit 131, so as to prevent unnecessary sensing stoppage and enable sensing and compensation for a change in the characteristic value of the subpixel to be performed.

The controller 140 may control sensing of the characteristic value of the subpixel by the sensing unit 131 in the sensing period in which the sensing unit 131 senses the characteristic value of the subpixel.

Figure 8:
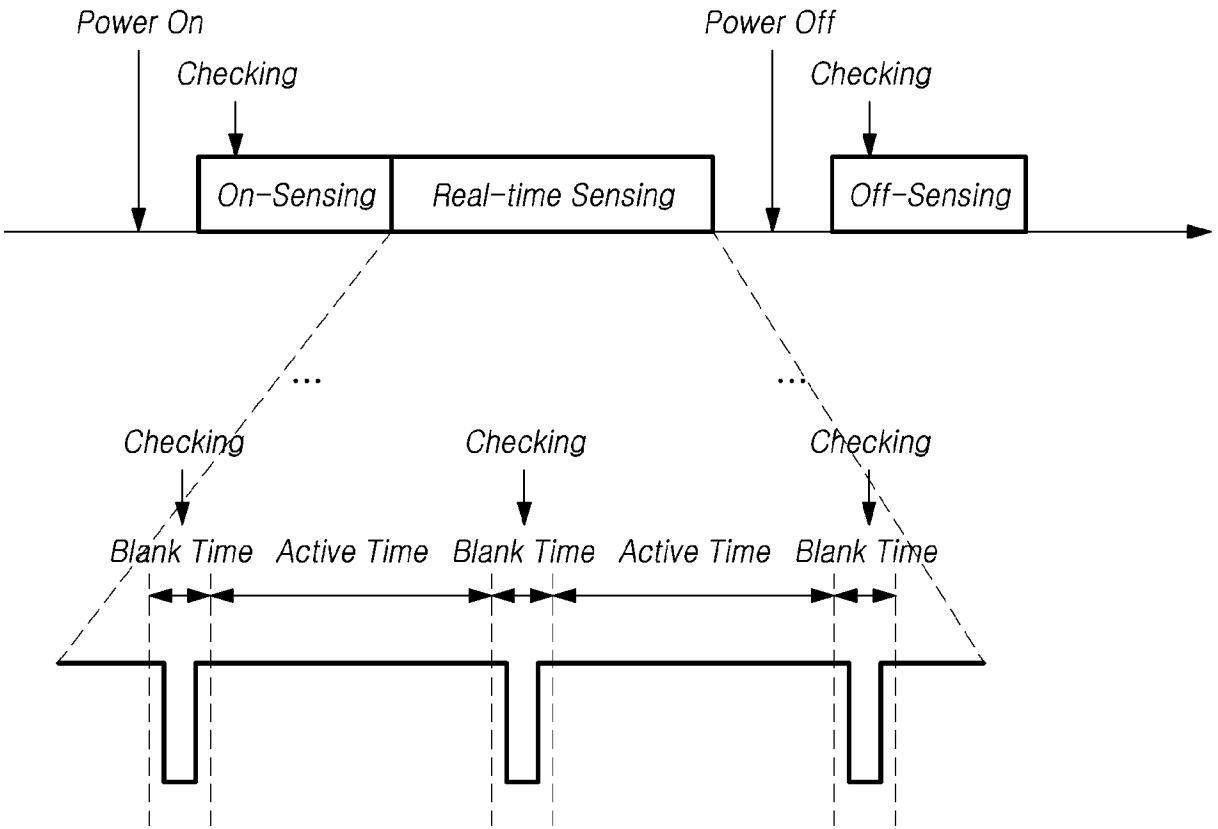
FIG. 8 is a diagram illustrating an example of timing for checking whether there is an abnormality in a sensing environment in an organic light emitting display device according to the present disclosure.

FIG. 8 illustrates an example of timing for checking by the controller 140 whether a sensing environment is normal.

Referring to FIG. 8, the sensing unit 131 may sense a characteristic value of a subpixel before a power-on signal is received from a system and a display starts driving (On-Sensing).

Alternatively, the sensing unit 131 may sense the characteristic value of the subpixel in real time during a blank period, in which no image data is output, during a display driving period (Real-time Sensing).

Alternatively, the sensing unit 131 may sense the characteristic value of the subpixel after a power-off signal is received from the system (Off-Sensing).

The controller 140 may check whether there is a defect in a sensing environment and controls sensing of the characteristic value of the subpixel by the sensing unit 131, before the sensing unit 131 starts sensing the characteristic value of the subpixel in the sensing period in which on-sensing, real-time sensing, or off-sensing is performed.

For example, when the power-on signal is received from the system, the controller 140 transmits a command signal to the sensing unit 131 and receives a feedback signal corresponding to the command signal, before the display starts driving.

The controller 140 compares the received feedback signal with a response signal designated for the transmitted command signal, and transmits a sensing start control signal to the sensing unit 131 to enable the sensing unit 131 to sense the characteristic value of the subpixel when the feedback signal and the response signal match.

When the feedback signal and the response signal do not match each other, the controller 140 transmits a sensing stop control signal to the sensing unit 131 to prevent erroneous compensation performed based on sensing data acquired when the sensing environment has a defect.

Further, as the example described above, the controller 140 may control sensing of the characteristic value of the subpixel by the sensing unit 131 based on the number of times of detections in which the sensing environment has a defect.

Further, the controller 140 may check whether there is a defect in the sensing environment in all the on-sensing, real-time sensing, and off-sensing periods, check for a defect of the sensing environment only in a predetermined sensing period, and control the characteristic value of the subpixel by the sensing unit 131.

Detection of a defect in the sensing environment may be available for all periods in which the sensing unit 131 senses the characteristic value of the subpixel, and it is thus possible to prevent erroneous compensation and an image abnormality due to an error of the sensing data.

Figure 9:
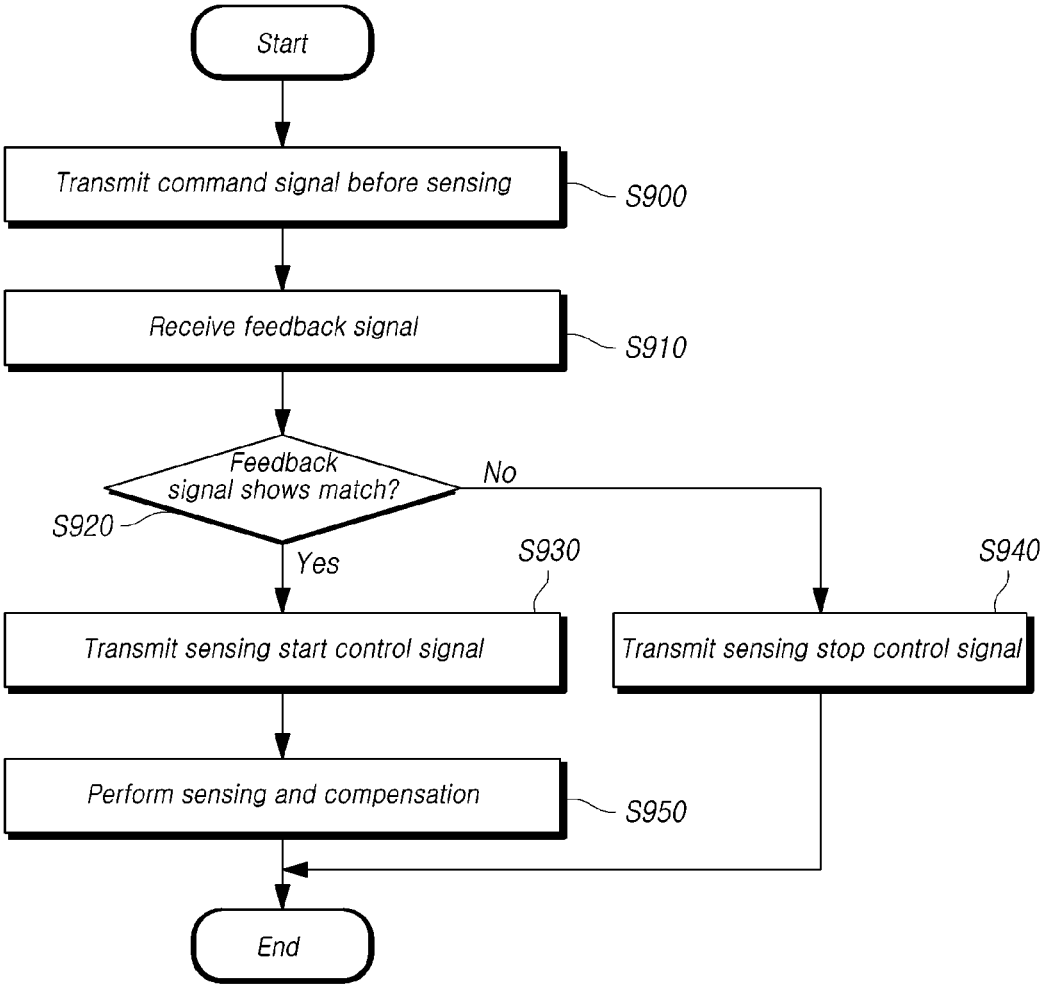
FIG. 9 and FIG. 10 are flow charts illustrating procedures of checking by an organic light emitting display device whether there is an abnormality in a sensing environment according to the present disclosure.
Figure 10:
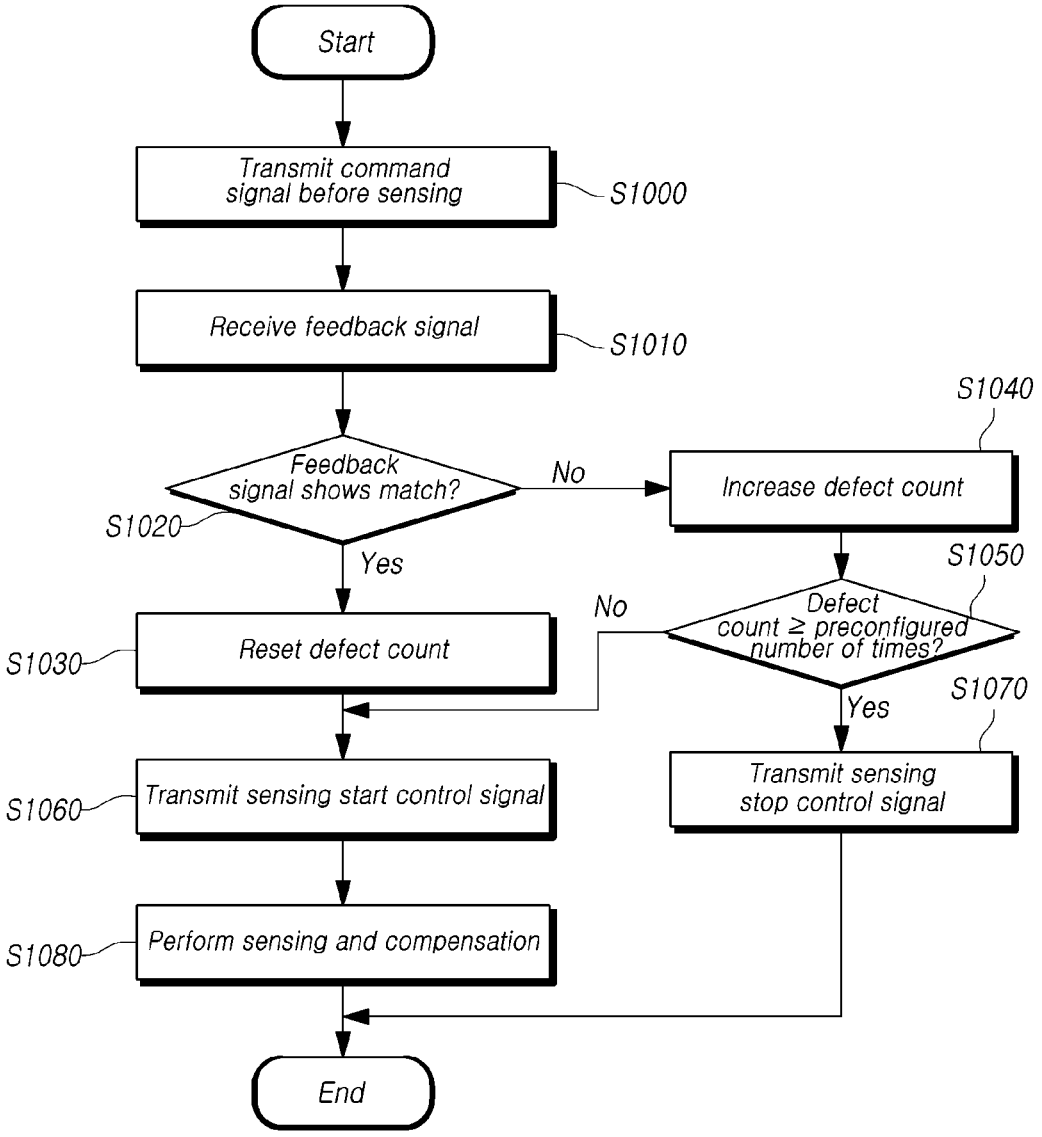

FIG. 9 and FIG. 10 illustrate procedures of checking whether a sensing environment has a defect in a sensing period in which a characteristic value of a subpixel is sensed, in the organic light emitting display device 100 according to the present aspects.

Referring to FIG. 9, the controller 140 transmits a command signal to the sensing unit 131 disposed in the data driver 130 S900 before the sensing unit 131 performs sensing in a sensing period for sensing of a characteristic value of a subpixel.

The controller 140 receives a feedback signal from the sensing unit 131 in response to the transmitted command signal 5910, and compares the received feedback signal with a response signal designated for the transmitted command signal 5920.

The controller 140 transmits a sensing start control signal to the sensing unit 131 S930 when the received feedback signal matches the response signal, and causes sensing and compensation to be progressed 5950.

The controller 140 transmits a sensing stop control signal to the sensing unit 131 S940 when the received feedback signal and the response signal do not match, and prevents erroneous compensation due to an error of the sensing data in a state where the sensing environment has a defect.

FIG. 10 illustrates a procedure of controlling sensing of a characteristic value of a subpixel by the sensing unit 131 based on the number of times of errors of a feedback signal received from the sensing unit 131.

Referring to FIG. 10, the controller 140 transmits a command signal to the sensing unit 131 S1000 before the sensing unit 131 starts performing sensing in a sensing period, and receives a feedback signal for the command signal S1010.

When the feedback signal matches a response signal designated for the transmitted command signal S1020, the controller 140 resets a defect count S1030. Further, the controller 140 transmits a sensing start control signal to the sensing unit 131 S1060, so as to cause sensing and compensation to be performed S1080.

When the feedback signal does not match the response signal, the controller 140 increases a defect count by one S1040, and checks whether or not the defect count is equal to or more than a preconfigured number of times (e.g., three times) S1050.

The controller 140 transmits a sensing stop control signal to the sensing unit 131 S1070 when the defect count has a value equal to or larger than the preconfigured number of times, and thus prevents an image abnormality due to erroneous sensing and compensation in a case where a sensing environment has a defect.

The controller 140 transmits a sensing start control signal to the sensing unit 131 S1060 when the defect count has a value smaller than a preconfigured number of times, and causes sensing and compensation to be performed S1080.

According to the present disclosure, detection of whether a sensing environment has a defect may be possible through transceiving a command signal and a feedback signal between the controller 140 and the data driver 130 before performing sensing during a period for sensing of a characteristic value of a subpixel.

An error in sensing data due to sensing when a sensing environment has a defect can be prevented and an image abnormality due to erroneous compensation can also be prevented, by controlling sensing of a characteristic value of a subpixel according to whether or not the sensing environment has a defect.

Further, unnecessary sensing stoppage can be decreased and compensation for a change in a characteristic value of a subpixel is achieved, by outputting a sensing stop control signal only when a predetermined number of times of errors or more are detected in the sensing environment.

Although aspects of the present disclosure has been described for illustrative purposes, those skilled in the art will appreciate that various modifications, additions and substitutions are possible, without departing from the scope and spirit of the present disclosure as disclosed in the accompanying claims. Further, exemplary aspects of the present disclosure are intended to describe the technical ideas of the present disclosure and are not intended to limit the same. Therefore, the scope of the present disclosure is not limited by the exemplary aspects. The scope of the present disclosure shall be construed on the basis of the accompanying claims in such a manner that all of the technical ideas included within the scope equivalent to the claims belong to the present disclosure.

What is claimed is:

1. An organic light emitting display device comprising:

an organic light emitting display panel configured to have a plurality of gate lines and a plurality of data lines and include a plurality of subpixels arranged in areas where the gate lines and the data lines intersect;

a gate driver configured to drive the plurality of gate lines;

a data driver configured to drive the plurality of data lines;

a controller configured to control the gate driver and the data driver;

a sensing circuit disposed in the data driver and configured to sense characteristic values of the subpixels during a sensing period; and a sensing control circuit disposed in the controller, configured to transmit a command signal to the sensing circuit, and receive a feedback signal for the command signal before the sensing circuit senses characteristic values of the subpixels during the sensing period to check a defect in an environment for sensing of the characteristic values of the subpixels, and output a control signal that controls the sensing circuit according to the received feedback signal to determine if the sensing the characteristic values of the subpixels is performed, wherein the command signal is transmitted through a packet allocated at a transceiving interface between the controller and the data driver and has X bits, and a response signal predesignated for each command signal has Y bits having a value larger than the X bits in order to detect the defect in the environment for sensing of the characteristic values of the subpixels.

2. The organic light emitting display device of claim 1, wherein the sensing control circuit is configured to compare the feedback signal received from the sensing circuit with the predesignated response signal for the command signal transmitted to the sensing circuit, and output the control signal that controls the sensing circuit based on a comparison result.

3. The organic light emitting display device of claim 2, wherein the sensing control circuit is configured to transmit a sensing stop control signal to the sensing circuit when the feedback signal does not match the predesignated response signal.

4. The organic light emitting display device of claim 2, wherein the sensing control circuit is configured to increase a defect count by at least one when the feedback signal does not match the predesignated response signal, and transmit a sensing stop control signal to the sensing circuit when the defect count has a value equal to or greater than a preconfigured number of times.

5. The organic light emitting display device of claim 4, wherein the sensing control circuit is configured to reset the defect count when the feedback signal matches the predesignated response signal.

6. The organic light emitting display device of claim 1, further comprising a compensation circuit configured to generate compensation data based on the sensed characteristic values of the subpixels when a sensing stop control signal that stops sensing of the sensing circuit is not output.

7. A controller for organic light emitting display, comprising:

a signal transmitting circuit configured to transmit a command signal to a data driver before the data driver senses characteristic values of subpixels arranged in the organic light emitting display during a sensing period in which characteristic values of the subpixels are sensed;

a signal reception circuit configured to receive a feedback signal for the transmitted command signal before the data driver senses the characteristic values of the subpixels to check a defect in an environment for sensing of the characteristic values of the subpixels; and a sensing control circuit configured to control transmission of the command signal, compare the received feedback signal with a predesignated response signal for the transmitted command signal, and output a control signal that controls sensing of characteristic values of the subpixels of the data driver based on a comparison result to determine if the sensing the characteristic values of the subpixels is performed, wherein the command signal is transmitted through a packet allocated at a transceiving interface between the controller and the data driver and has X bits, and a response signal predesignated for each command signal has Y bits having a value larger than the X bits in order to detect the defect in the environment for sensing of the characteristic values of the subpixels.

8. The controller of claim 7, wherein the sensing control circuit is configured to output a sensing stop control signal that stops sensing of characteristic values of the subpixels of the data driver when the received feedback signal does not match the predesignated response signal.

9. The controller of claim 7, wherein the sensing control circuit is configured to increase a defect count by at least one when the received feedback signal does not match the predesignated response signal, and configured to output a sensing stop control signal that stops sensing of characteristic values of the subpixels of the data driver when the defect count has a value equal to or greater than a preconfigured number of times.

10. The controller of claim 9, wherein the sensing control circuit is configured to reset the defect count when the received feedback signal matches the predesignated response signal.

11. An organic light emitting display device for preventing errors in sensing characteristic values of subpixels and compensating for changes based on the sensed characteristic values, comprising:

a sensing circuit sensing the characteristic values of the subpixels during a sensing period;

a signal transmitting circuit transmitting a command signal to the sensing circuit prior to the sensing the characteristic values of subpixels during the sensing period;

a signal reception circuit receiving a feedback signal for the transmitted command signal prior to the sensing the characteristic values of the subpixels during the sensing period to check a defect in an environment for sensing of the characteristic values of the subpixels; and a sensing control circuit controlling transmission of the command signal, comparing the received feedback signal with a predesignated response signal for the transmitted command signal, and outputting a control signal controlling the sensing the characteristic values of the subpixels based on the comparison to determine if the sensing the characteristic values of the subpixels is performed, wherein the command signal is transmitted through a packet allocated at a transceiving interface between the controller and the data driver and has X bits, and a response signal predesignated for each command signal has Y bits having a value larger than the X bits in order to detect the defect in the environment for sensing of the characteristic values of the subpixels.

12. The organic light emitting display device of claim 11, wherein the sensing control circuit transmits a sensing stop control signal to the sensing circuit when the feedback signal does not match the predesignated response signal.

13. The organic light emitting display device of claim 11, further comprising a counter increasing a defect count by at least one when the feedback signal does not match the predesignated response signal, and transmitting a sensing stop control signal to the sensing circuit when the defect count has a value equal to or greater than a preconfigured number of times.

14. The organic light emitting display device of claim 13, wherein the counter resets the defect count when the feedback signal matches the predesignated response signal.

15. The organic light emitting display device of claim 11, wherein the command signal includes a sensing start control signal starting the sensing of the sensing circuit and a sensing stop control signal stopping the sensing of the sensing circuit.

16. The organic light emitting display device of claim 15, further comprising a compensation circuit generating compensation data based on the sensed characteristic values when the sensing stop control signal is not output.

17. The organic light emitting display device of claim 11, wherein the sensing circuit performs an on-sensing process of sensing the characteristic values of the subpixels prior to receiving a power-on signal from the display device and starting to drive the display device.

18. The organic light emitting display device of claim 17, wherein the sensing circuit performs a real-time sensing process of sensing the characteristic values of the subpixels in real time during a blank period when no image data is output during a display driving period.

19. The organic light emitting display device of claim 18, wherein the sensing circuit performs an off-sensing process of sensing the characteristic values of the subpixels after receiving the power-off signal from the display device.

20. The organic light emitting display device of claim 19, wherein the organic light emitting display device is configured to confirm the error in the sensing characteristic values of the subpixels prior to the sensing circuit starts sensing the characteristic values of the subpixels during the sensing period, wherein the on-sensing process, the real-time sensing process and the off-sensing process are performed during the sensing period.

* * * * *